United States Patent [19]

Flowers et al.

[11] Patent Number: 4,964,348

[45] Date of Patent: Oct. 23, 1990

[54] DROP END, OPEN TOP RAIL CAR

[75] Inventors: Richard W. Flowers; John R. Murray, Jr., both of Findlay, Ohio

[73] Assignee: Differential Steel Car Company, Findlay, Ohio

[21] Appl. No.: 387,490

[22] Filed: Jul. 31, 1989

[51] Int. Cl.[5] ..... B61D 9/02; B61D 17/06

[52] U.S. Cl. ..... 105/406.2; 105/261.1; 105/283; 105/308.1; 105/313; 105/458

[58] Field of Search ..... 105/406.1, 406.2, 436, 105/458, 240, 258, 261, 261.2, 280, 283, 284, 429, 269, 274, 459, 392.5, 259, 260, 261.1, 262.2, 265, 268, 285, 287, 289, 296, 308.1, 309, 310, 313; 267/64.11

[56] References Cited

U.S. PATENT DOCUMENTS

| | | | |
|---|---|---|---|
| Re. 23,814 | 4/1954 | Ingram . | |
| 1,972,042 | 8/1934 | Flowers . | |
| 2,052,867 | 9/1936 | Cartzdafner et al. . | |
| 2,329,554 | 9/1943 | Pietsch . | |
| 2,484,512 | 10/1949 | Ingram . | |
| 2,506,218 | 5/1950 | Ingram . | |
| 2,738,733 | 3/1956 | Flowers . | |
| 2,769,406 | 11/1956 | Goodwin . | |
| 3,118,394 | 1/1964 | Flowers . | |
| 3,421,454 | 1/1969 | Connerat | 105/458 |
| 3,474,741 | 10/1969 | Ingram . | |
| 3,521,576 | 7/1970 | Murray | 105/458 |
| 3,556,020 | 1/1971 | Akers | 105/458 |
| 4,057,236 | 11/1977 | Hannells | 267/64.11 |

FOREIGN PATENT DOCUMENTS

| | | | |
|---|---|---|---|
| 0898911 | 6/1962 | United Kingdom | 105/458 |

OTHER PUBLICATIONS

The Car and Locomotive Encyclopedia (1980) p. 143.
The Car and Locomotive Encyclopedia (1970) p. 147.

*Primary Examiner*—Robert P. Olszewski
*Assistant Examiner*—Mark T. Le
*Attorney, Agent, or Firm*—Willian Brinks Olds Hofer Gilson & Lione

[57] ABSTRACT

A pivoted drop end for a railway car which is adapted to be manipulated (lifted) by power equipment in the car to open or close the car end. The car end includes lower side posts, each having a cam follower running in a cam on the car frame which swings the car end about a pivot carried on each of the posts. The pivots are guided in a vertical slot and cooperates with the cam. The car end is opened outwardly of the car and rests in open horizontal position on a pedestal support of the frame so that adjacent open car ends form a bridge to move loads longitudinally of the train. The car end is dampened in lowering (opening) movement by dashpots connected between the car end and car frame. A side dumping railway car tilts the car body to either side by sets of pneumatic cylinders, each set being alternatively under control of a valve. The drop end of the car includes an exterior cam member that engages a lockout mechanism for inactivating the sets of pneumatic cylinders by setting the control valve of both sets of cylinders to exhaust whenever either drop end of the car is in open position, i.e., either end is lowered.

16 Claims, 8 Drawing Sheets

DROP END, OPEN TOP RAIL CAR

FIELD OF THE INVENTION

The present invention relates to railroad cars, such as open top cars or gondola cars, with drop ends. More specifically, the invention is employed in rail cars that are used with a loader device, such as a crane or power shovel, to travel the length of the string of cars by dropping the ends and employing the dropped ends to travel through the string of cars to a work station or loading station.

BACKGROUND OF THE INVENTION

When conducting certain railroad work alongside the track, a power shovel or material handling machine is mounted on a flat bottom service car. The power shovel, or the like, is employed to dig along the side of the track and load the material in the car. Conversely, the material handling device may be used to unload the car of material. In either case, the shovel or device travels the length of the car in doing its work and in so doing, can only reach and fill or unload two adjacent cars on either side of the car in which the shovel is mounted. To do other cars require switching cars in the train and locating the service car near a fresh empty or full car, as the case may be.

The U.S. Pat. No. 2,052,867 discloses a drop end railroad car which allows a train of these cars to provide a continuous platform as the length of the train of open top cars along which the power shovel or material handling device may be moved under its power while loading or unloading material in the cars. The drop ends of the adjacent cars extend flush with the car floors to form bridges for traveling from one car to the next of the train.

THE RELATED PRIOR ART

The use of drop end doors in railroad cars is illustrated in U.S. Pat. Nos. Re 23,814; 2,484,512; 2,506,218; and 2,769,406. In each of these prior art designs, the drop end of the rail car is designed to drop inwardly toward the interior of the car. The car end in these examples is mounted with the aid of springs or torsion bars to enable workmen to raise the door and close it without assistance from outside machinery.

The aforementioned Pat. No. 2,052,867 discloses a car end that is lowered outwardly of the car about a pivot hinge and the end is supported in a lowered, open position by a series of external braces. The braces are supported on large springs which compress with a heavy load traveling across the dropped car end.

SUMMARY OF THE INVENTION

The present invention provides an improved mounting and mechanism for lowering the drop end of a railway car at either end of the car using the power shovel or power machine in the cars of the train to lower and raise the car end about a horizontal pivot near the level of the floor of the car end.

The invention includes a cam mounted at the opposite sides of the car at either end thereof and a follower is supported on a member depending from the lower end of the car end; the cam and follower manipulates and guides the car end in its swinging movements between closed and open positions. The car end in its open position is swung outwardly to a horizontal attitude and rests upon a support attached to the car frame overlying the coupling. The open car ends of adjacently coupled cars provide a bridge for moving machinery, such as a power shovel, from one car to the next. The car end mechanism includes a damping device in the form of a dash-pot cylinder and piston of novel construction which regulates the speed of lowering the car end to open position and cushions the car end when lowered and supporting the machinery traveling across it.

The present invention is adapted for use with rail cars with fixed longitudinal sides, or with rail cars of the known side dump variety. A side dump car typically employs opposite longitudinally extending sides pivoted at their lower edge at or near the floor of the car and the body of the car is pivotally supported by trunnions on the rail car chassis. The car is unloaded by releasing and pivoting one side outwardly from its uptight position to a laterally extending position while rocking the car body about a longitudinal pivot axis. This pivot axis is located laterally from the longitudinal center of the chassis. The car body is "dumped" by heavy duty air cylinder piston assemblies supported on the car chassis and connected to the car body. The dump car body is supported on sets of laterally spaced fulcrums on either side of center of the car. The car dumps to either side by operator activating air cylinders pivoting the car to about a fifty degree angle at a selected side of the train. Only the lower side of the car opens on the dumping side, the other (upper) side remaining "closed".

The present invention includes a safety linkage activated by either of the drop ends of the car. The linkage prohibits accidentally side dumping of the car when either of the drop ends is opened (lowered). This linkage engages a member which places all air cylinders in exhaust and blocks the operator's linkage for activating either set of the side dumping air cylinders, thereby preventing any accidental side dumping of the car when a drop end of the car is not in a "closed" (upright) position. Inasmuch as a power shovel or other equipment is on the floor of the car, it is used to lower the drop end of the car. It is, therefore, important the side dump feature not be activated, and, in effect, is "locked out" of operation.

The invention provides a further mechanism for dampened lowering of the drop end of the car. When closed, the car end is opened by lifting it in vertical guides causing its cam followers running on the cams to manipulate the car end causing it to swing outwardly. During the swinging movement, the weight of the car end is placed on the piston rods of dash-pot devices connected between the car's underframe and the car end. The dash-pot device is partially filled with oil. The dampening is provided by internal restriction valves regulating the rate of movement of the piston in the cylinder toward lowering the car end unit. When the car end is fully open (lowered), it rests upon a horizontal surface of a pedestal on the car frame establishing the car end in an attitude level with the floor of the car. In the lowered position, the valving in the cylinder-piston provides a cushion to the movement of machining across the horizontally extending car end.

It is, therefore, a principal object of the invention to provide improved drop end structure in a railway car suitable for use in a train for moving powered machinery from car to car.

A further object of the invention is to dampen the swinging movement of the car end by hydraulic cylinders and cushion the car end in lowered position against abrupt bouncing motion by loads on or traversing the lowered ends; plus assisting holding the car ends closed in transit.

Another object of the invention is to provide drop ends in a side dumping railroad car with a safety interlock which prevents side dumping of the car when the drop ends are lowered.

For a further understanding of the invention and the objects thereof, attention is directed to the appended drawings and the following description thereof, to the detailed description of the preferred embodiment and to the appended claims.

DETAILED DESCRIPTION OF THE PREFERRED EMBODIMENT

Figure 2:
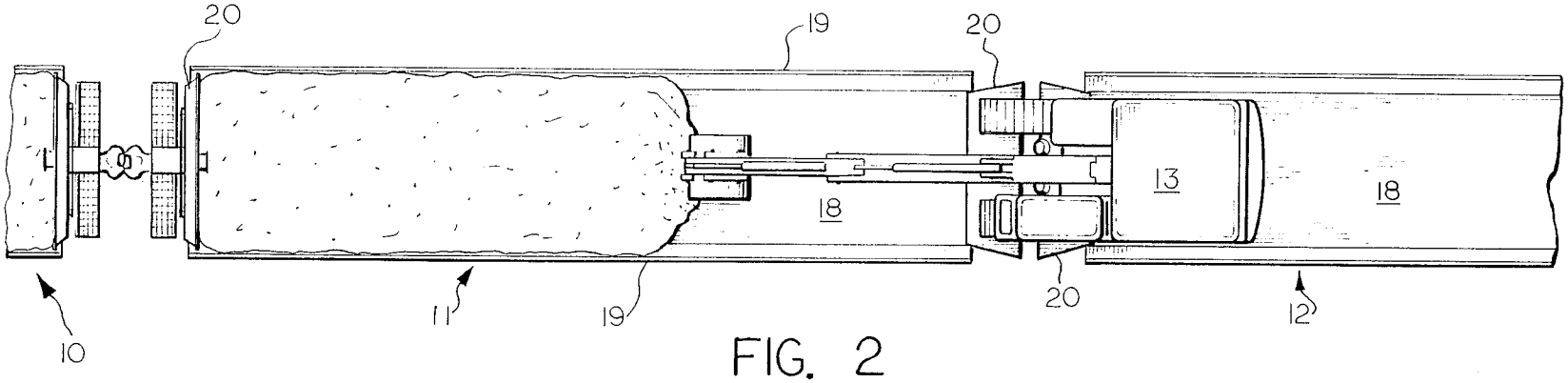
FIG. 2 is a top plan view of the cars of the train shown on FIG. 1.
Figure 1:
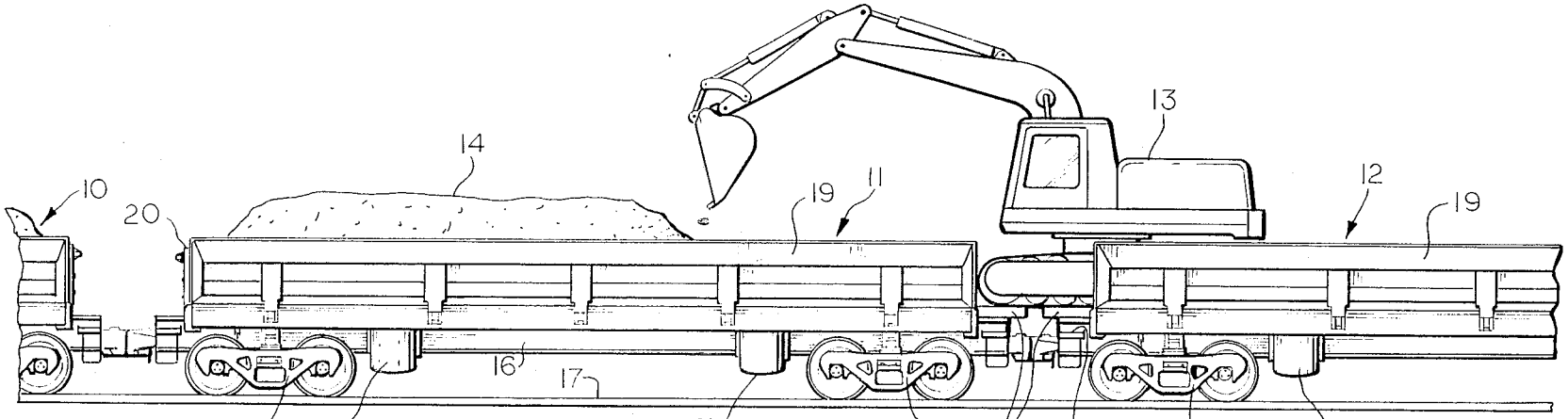
FIG. 1 is a side elevational view of a string of railway cars in a train on which a power shovel back hoe is traveling between the cars bridged by adjacent drop ends of two adjacent cars.
Figure 3:
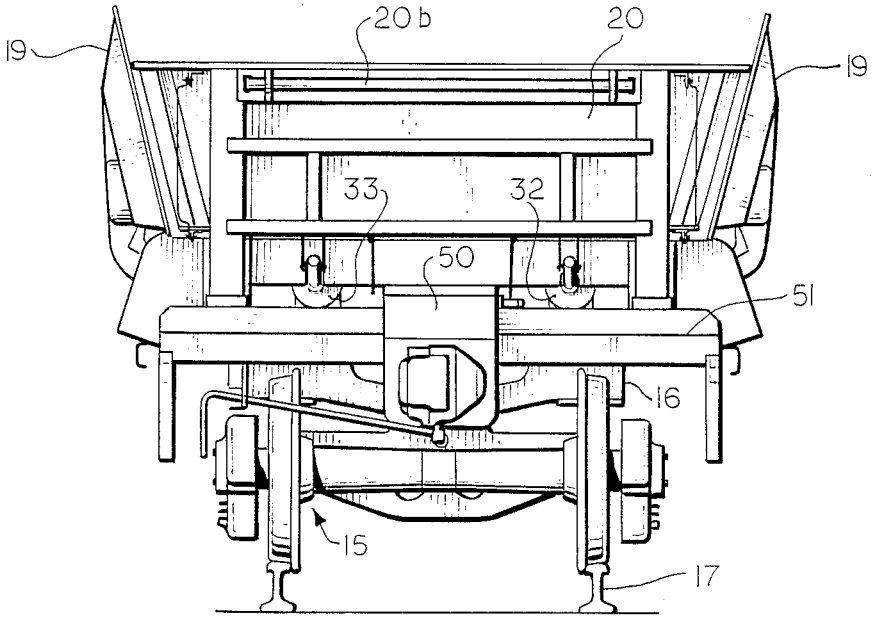
FIG. 3 is an end elevational view of one of the railway cars of FIG. 1 including the present invention.
Figure 4:
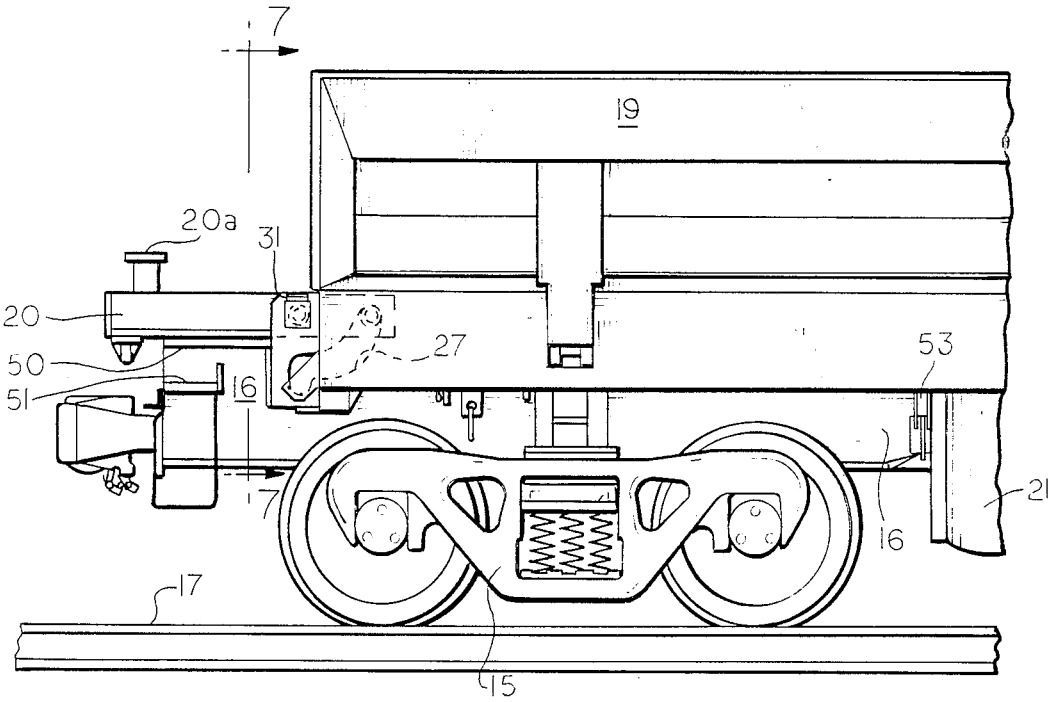
FIG. 4 is a partial side elevational view of one end portion of the railway car shown on FIG. 3.

As shown on FIGS. 1 through 5, a series of three coupled side dump railway gondola cars 10–12 in a train of cars is shown in the process of loading or unloading a train, as the case may be. A back hoe power shovel 13 is traversing the cars longitudinally proceeding from car 12 into car 11 to handle bulk material 14. Each of cars 10–12 are constructed similarly in the illustrative example having a set of trucks 15 at each end of the car attached to the under frame 16 which make up the car's chassis running on the rails 17. The car body is comprised of a floor 18, opposite longitudinal sides 19 and opposite ends 20. The sides are supported by bolsters under the floor which rest a pair of spaced longitudinal trunnions. The car shown is a side dumping type well known in the industry and may be raised about one of the individual trunnions, right or left, by air cylinders 21. The sides are pivoted along their lower edge to lower automatically on the side dumping is performed until the car's side 19 is approximately in the plane of floor 18. The cylinders 21 are in a series on either side of the car, their piston rod being pin connected to a bracket on the underside of floor 18. The air cylinders are alternatively operated to dump the car, right or left as selected by the operator. The side dump car and air cylinder operation is disclosed in U.S. Pat. Nos. 1,972,042 and 2,738,733 (incorporated herein by reference). The cylinders are activated by valves controlled by longitudinal operating shafts for sets of cylinders 21 on either side of the car. Only one set of cylinders 21 can be activated at one time by the arrangement of the valves and valve operating shafts as disclosed in U.S. Pat. No. 3,118,394 (incorporated herein by reference).

Figure 8:
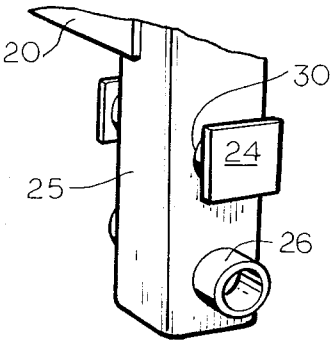
FIG. 8 is an enlarged fragmentary view in perspective of the lower reaches of the sidepost of the drop end frame showing the guide and cam follower thereon.
Figure 7:
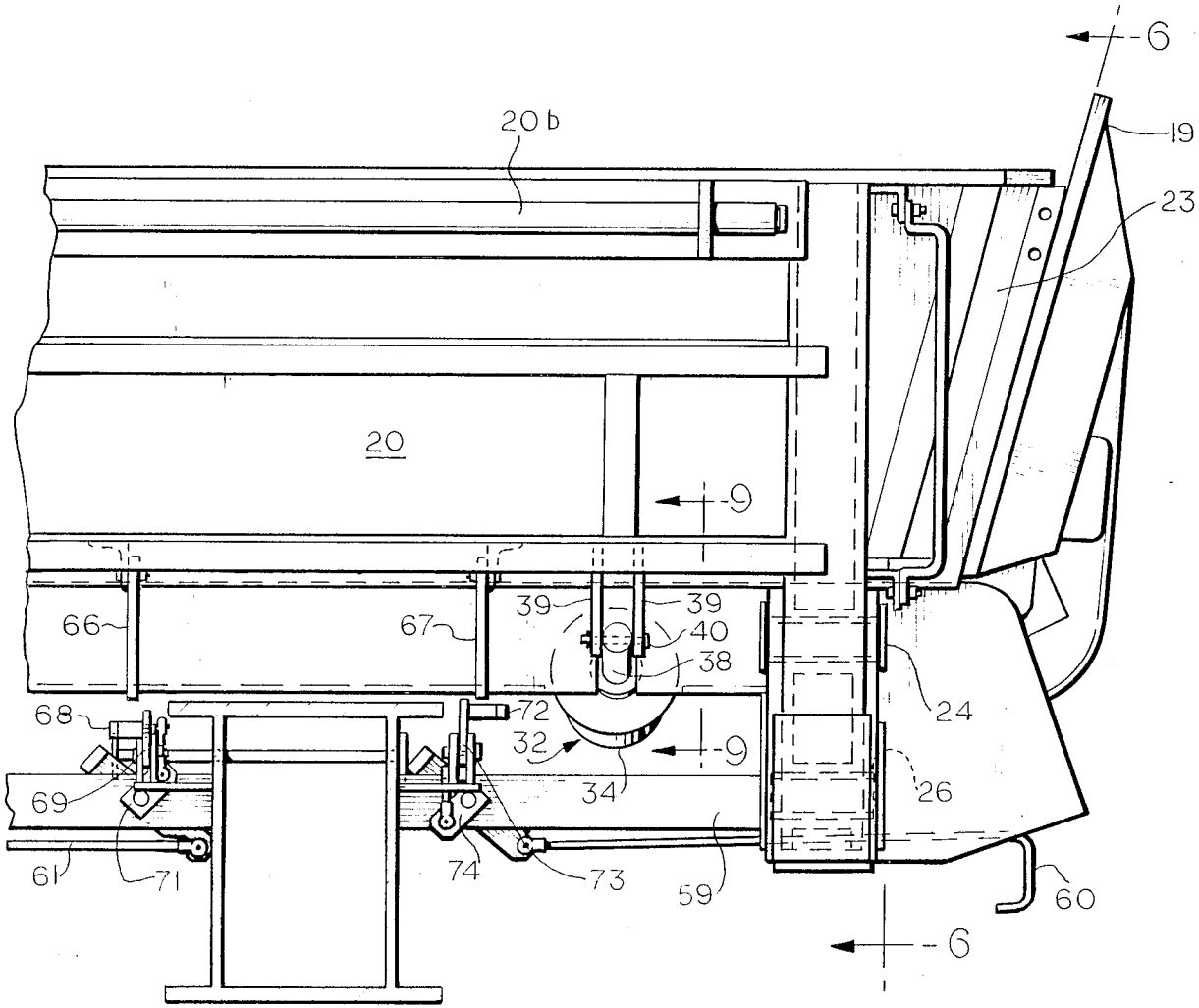
FIG. 7 is a partial sectional end elevational view taken along line 7—7 on FIG. 4.
Figure 9:
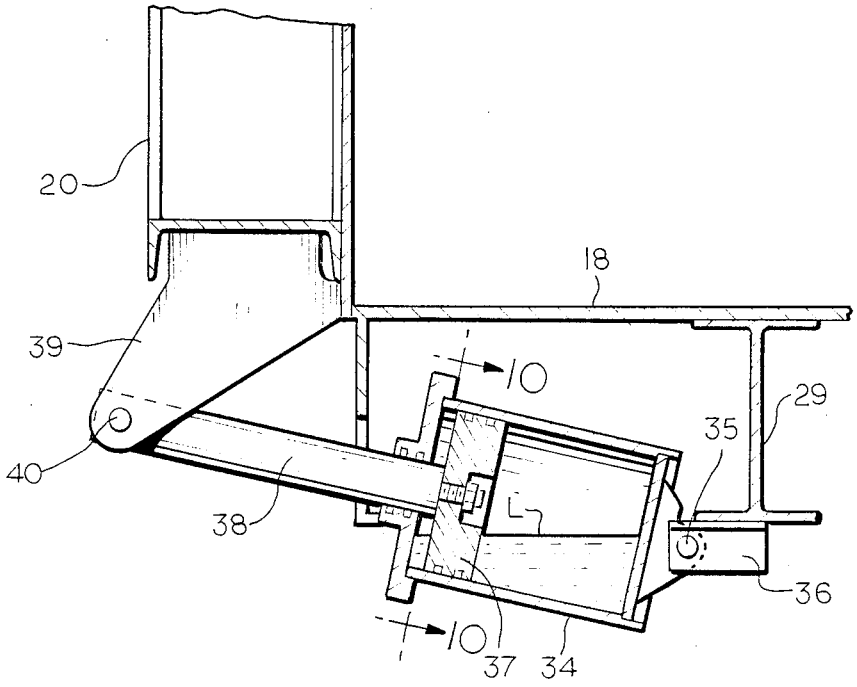
FIG. 9 is a sectional elevational view taken along line 9—9 on FIG. 7.

The car ends 20 are shown on FIGS. 3–6 and are operable to be swung between closed upright position and open lowered position. The car end 20 includes spaced-apart, lower depending members in the form of vertical posts of hollow construction disposed near either outside edge of the car end. The post structure is adjacent either lateral end of the structure of car end 20. The side extremities 23 of car end 20 are tapered outwardly to fit with the sloped position of sides 19 and meet the sides of the car and close the end of the load compartment. Car end 20 has its lower post portion 25 extending below the plane of floor 18. A cam follower 26 is supported on each post portion 25. A closed cam surface 27 is formed in a stationary housing 28 fixedly secured to the frame 29 on opposite sides of the car. Cam 27 is two sided and is directed upwardly and inwardly on frame 29. Each lower portion 25 of each of the posts also include a pivot in the form of a sleeve fixedly connected on the post (see FIG. 8) which is received in U-shaped cam slot 31 formed in the cam plate of the housing 27. On the outer end of sleeve 30 is a retaining plate 24 which retains the sleeve in cam slot 31. Plates 24 each slide vertically along the exterior face of the cam plate.

Figure 6:
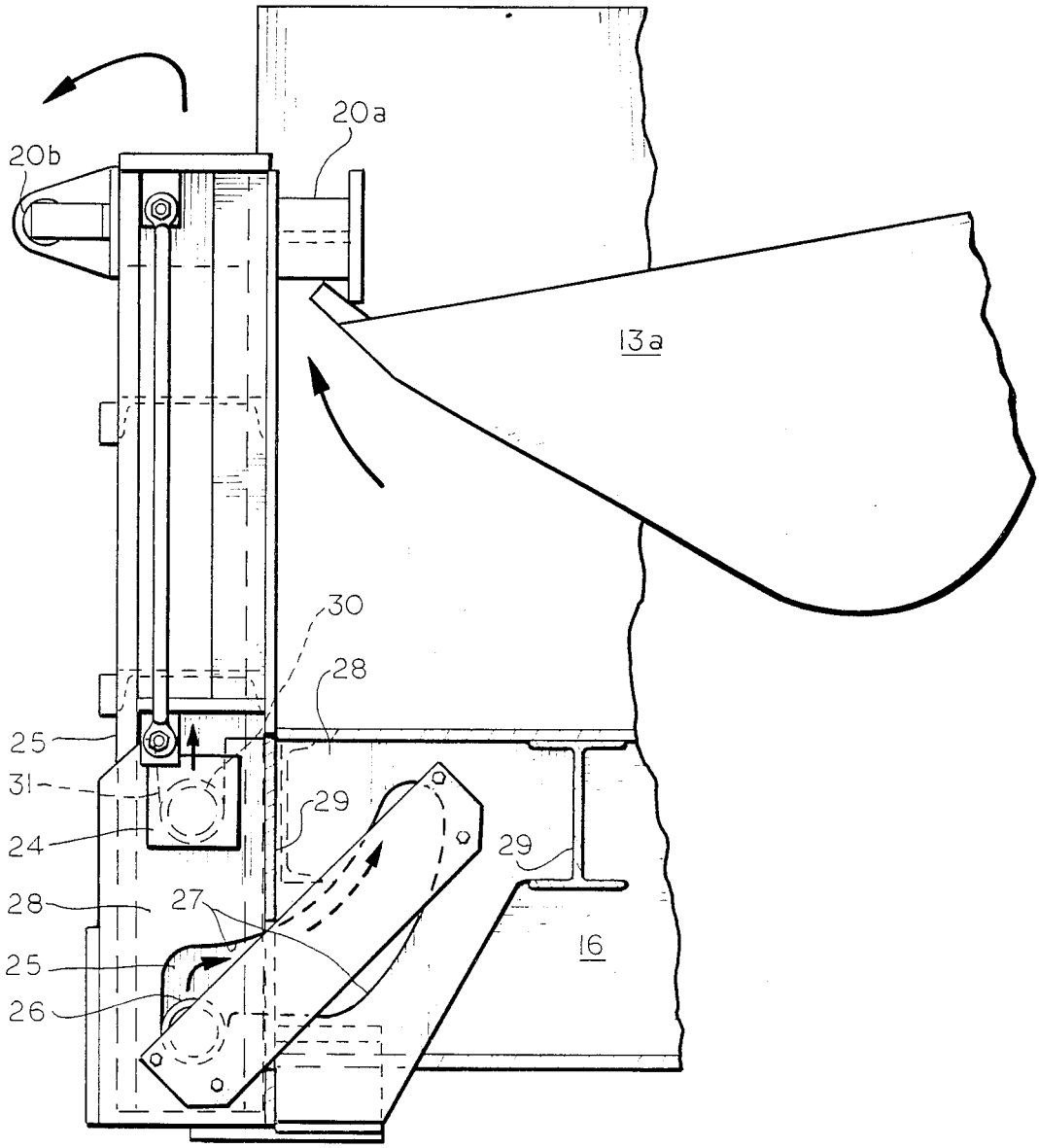
FIG. 6 is a fragmentary sectional elevational view taken along line 6—6 on FIG. 7; the bucket of a power shovel being added to illustrate power machinery for lifting and lowering the drop end of the railway car.

The drop end 20 of the car is shown in closed position on FIG. 6. It is swung to a lowered open position by lifting the car end by power of the back hoe's bucket 32 engaging an internally projecting bracket **20*a* on the inside surface of the car end. As the drop end is being raised, pivot sleeve 30 and cam follower 26 each follow the path of the cams they engage. Sleeve 30 provides the pivot axis for car end 20 and cam roller 26 and the path of cam 27 swing the car end 20 outwardly and downwardly about the pivot sleeve 30** as the car end is lifted.

Figure 10:
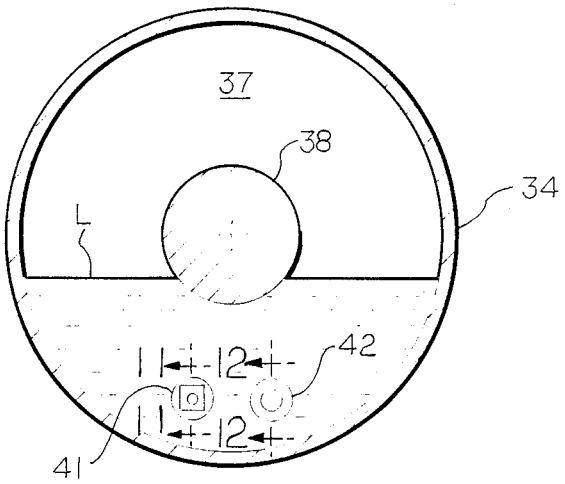
FIG. 10 is a sectional elevational view taken along line 10—10 on FIG. 9.
Figure 11:
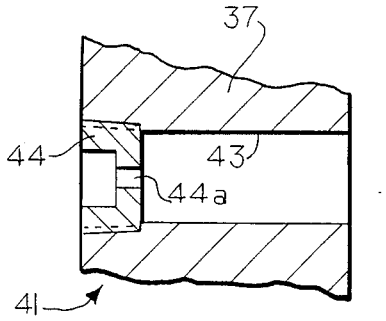
FIG. 11 is a sectional view taken along line 11—11 on FIG. 10 showing the restricted passageway for hydraulic fluid flow through the piston.
Figure 12:
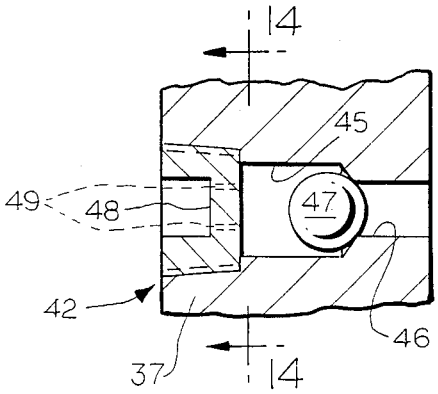
FIG. 12 is a sectional taken along line 12—12 on FIG. 10 showing the ball-check valve through the piston.
Figure 14:
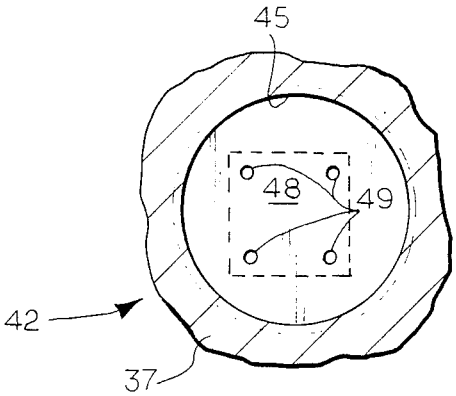
FIG. 14 is an enlarged, fragmentary view taken along line 14—14 of FIG. 12 showing in detail the ports for flow of fluid from the back to the front of the piston upon return stroke of the dash-pot device.

The lowering of car end 20 is controlled by a pair of dash-pot devices 32 and 33 each constructed as follows. Referring to FIGS. 3, 5, 7 and 9, the cylinder 34 is pivotally connected to the car frame at pin 35 in stationery bracket 36. Piston 37 has its piston rod 38 connected to spaced brackets 39 depending from the lower edge of the car end 20 by pivot pin 40. The cylinder is partially filled with hydraulic fluid to a level L. The piston 37 is located near the left hand side of the cylinder (FIG. 9) when car end 20 is closed. As shown on FIGS. 10–12, piston includes a restrictor valve 41 and a ball check valve 42 which are side-by-side and located at the lower level of piston 37. Restrictor valve 41 comprises a circular passage 43 bored in the piston extending from right to left on FIG. 9 and the inside of passage 43 is threaded to receive a threaded insert 44. The restrictor valve insert 44 includes an axial passage of small diameter relative to passage 43 and limits quantity of flow of fluid through the piston between the head end of cylinder 34 and the tail end of the cylinder. The restricted flow dampens the car end and limits the speed of movement of the car end 20 in its downward swinging movement between closed and open positions. The ball check valve 42 includes larger diameter counter bored passage 45 and smaller passage 46 in the piston 37. The interface between passages 45 and 46 provides a frusto-conical seat for ball 47. A threaded insert, shown on FIG. 14, is secured in passage 45 and includes a square portion 48 fabricated integrally therewith. The square portion 48 has four apertures 49 bored therethrough near its corners. The apertures are approximately ⅛ inch diameter. In the stroke for the piston 37 lowering the car end 20, ball 47 seats in passage 46 and blocks fluid flow through the piston 37. The only flow of fluid permitted is, therefore, through the restrictor valve passage 44*a*. In the opposite direction of movement of piston 37, such as occurs when raising car end 20 to its upright closed position, fluid flow is through the passage 46 unseating ball 47 and through the four apertures 49 moving the fluid to the other side of the piston. Movement in the direction of closing the car end is therefore relatively unrestricted.

The operation for opening and closing the car ends of the train of rail cars 10–12 is as follows. The power shovel 13 is moved over the floor of car 12 and as it reaches closed end of the car, the boom and bucket 13*a* lowers (opens) the closed end of car 12 by engaging the boss 20*a* on the inside of the car end and lifting it. The lifting movement engages the two cam followers at the lower end of the posts with the closed cam. This pivots the car end about the upper sleeve pivot of each of the posts as the sleeve moves upwardly in the slot. Accordingly, the car end is swung outwardly and downwardly to the open position. The gravity drop of the car end is cushioned by the dash-pot devices 32 and 33. The car end 20 pivots about sleeve 30 held in the upper slot 31 and swings to a horizontal position where it rests upon the pedestal 50 (FIGS. 4 and 5) centrally of the horizontal walkway 51. Bracket 20*a* is designed to fit within the under clearance of the power shovel when the car end is open so that the shovel may drive over it. As the shovel reaches the closed car end of the next car, the car end is lifted by hooking the shovel bucket under the outside cross bar 20*b* on the next car end lifting and lowering it in the same fashion until the car end rests on the pedestal 50 of car 11 in open position. The power shovel 13 may now proceed onto car 11 traveling across the two adjacent open car ends as a bridge. The same process is repeated for opening the car ends as the work progresses down the train of cars.

For closing the car ends 20, the reverse procedure is employed, whereby the power shovel hooks onto the members 20*a* or 20*b* and swings the car end to an upright position. At the end of the swinging movement, the car end is lowered and held closed by the lower cam. The sleeve follower 30 descends in slot cam 31 and the lower cam follower 26 is seated in the bottom of its cam 27, as is shown on FIG. 6.

Side Dumping Interlock

Figure 13:
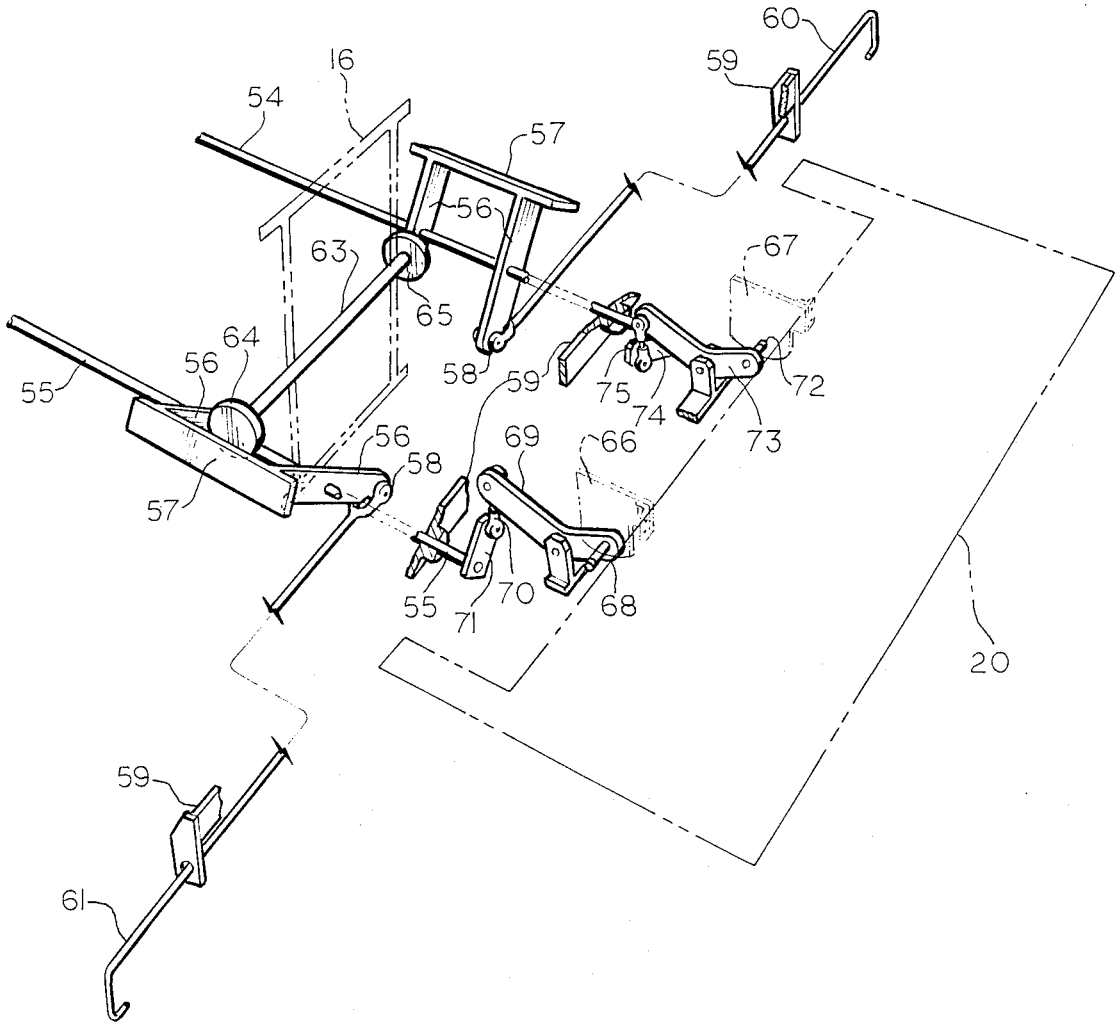
FIG. 13 is a perspective, spatial drawing of the controls and safety interlock for the side dump railroad car embodiment of the invention.

In the embodiment illustrated on the drawing, a side dumping car is shown. The general description of operation of a side dumping car is set forth in U.S. Pat. No. 3,118,394, cited earlier. The side dumping is accomplished to either side of the train by heavy air cylinders 21. The cylinders are mounted in separately controlled sets (three are shown) disposed lengthwise along opposite sides of the car. The cylinders along one side are under control of a valve 53 mounted on the under frame 16 of the car (FIG. 4) for inlet or exhaust of compressed air or similar pressure medium in these cylinders. The valve 53 is controlled by a rock shaft 54 extending the length of the car and longitudinally on the same side of the frame 16 as the aligned set of air cylinders. The shaft is rotatably supported by a cross member 59 of the under frame of the car. These air cylinders are energized on one side to tilt the car body toward the other side of the track. Duplicate set of air cylinders 21 and control valve 53 are provided on the other side of the frame for dumping to the opposite side of the track. These air cylinders are controlled by a separate longitudinal rock shaft 55 (FIG. 13).

Near opposite ends of the car, shaft 54 carries similar mechanism comprised of a set of spaced rock arms 56 connected intermediate their ends to be rotated by the shaft. The top ends of arms 56 have a rocker shoe 57. The opposite ends of one of the arms 56 is connected at a clevis 58 on the operator handle 60 journaled for reciprocating movement along the frame cross member 59. A plate (not shown) attached to the center beam 16 of the car underframe is straddled by the rock arms 56 and is placed to limit the extent of rocking movement of the rocker shoe 57 in either direction. The operator's handle 60 is capable of giving the shaft 54 a range of movement of about 90 degrees.

The other rock shaft 55 has a similar mechanism comprising rock arms 56 and rocker shoe 57 connected across the top ends of arms 56. The lower ends of one of the rock arms 56 is attached by a clevis 58 on the end of operator's handle 61. As seen on FIG. 13, pulling the operator's handle 61 outwardly rotates shaft 55 clockwise. This also rotates arms 56 and rocker shoe 57 in the same direction. The rocker shoes are connected by a reciprocating rod 63 slidably mounted in frame 16. Rod 63 moves freely transversely on the under frame. The opposite ends of reciprocating rod carries heads 64 and 65 which are in the paths of movement of the rocker shoes 57 and rod 63 is located so that the end of the one rocker shoe 57 strikes the head 65 of the rod and the other shoe strikes head 64. The rod 63 has a length selected such that when one rocker shoe 57 is in the air inlet position of its valve, the opposite head on the reciprocating rod forces the other rocker shoe 57 outwardly and consequently rotates its shaft and sets the valve associated with it into air exhaust position. The reciprocating rod connecting the two rocker shoes insures that air under pressure can never enter the dump cylinders on both sides of the car at the same time. The valves are so arranged that the operator pulling the handle 61 (for example) will inlet air to air cylinders 21 on that side of car resulting in tilting the car in a direction away from the operator. Pulling handle 60 performs similarly. The air cylinders after being energized and dumping the car are exhausted by moving operators handle 61 (for example) in the opposite direction to a neutral location, which exhausts the cylinders but does not inlet the air to cylinders on the opposite side of the car.

Figure 5:
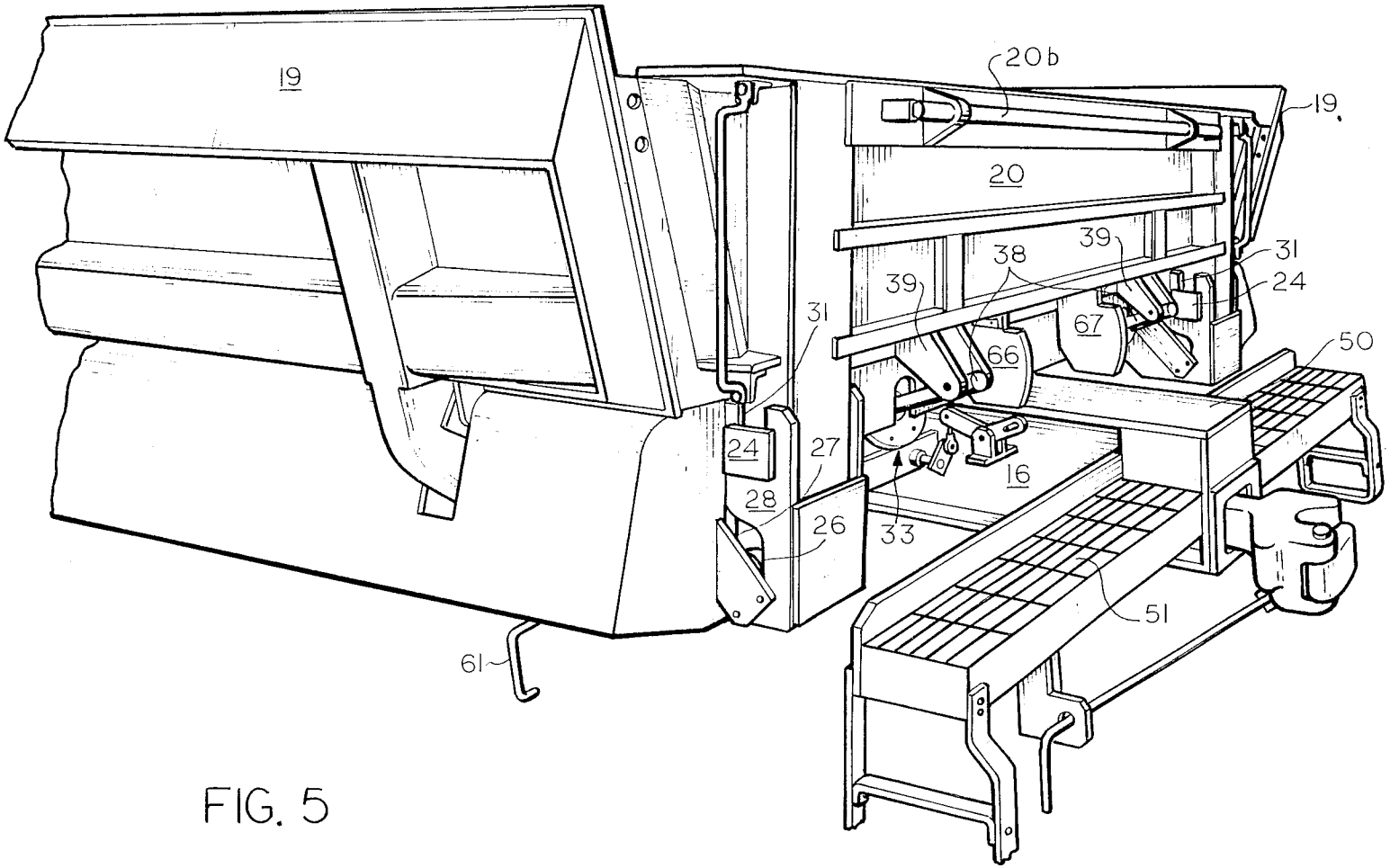
FIG. 5 is a three-quarter front perspective view partially showing the railway car of FIGS. 3 and 4 with the sets of tracks and track omitted for simplicity of illustration.

This invention provides a safety interlock preventing side dumping the car to either side of the track after either drop end of the car has been lowered. This is accomplished by cams 66 and 67 mounted on brackets on the lower edge of car end 20 (FIG. 5). These are shown in phantom outline of FIG. 13. The cams 66 and 67 descend together with the car end 20 and engage the respective cam followers 68 and 72, respectively. Cam 66 is aligned to engage follower 68 on the one end of rocker arm 69 pivoted on a cross frame member of the car. The opposite end of rocker arm 69 is pivotally connected to one end of vertical link 70, its other end being pivotally connected to the free end of crank 71. The crank 71 is rigidly connected to rock shaft 55. The sides 19 of the car are upright and the air cylinders are inactive for dumping the car. The cam 66 places the rock shafts 55 in neutral position where the air cylinders 21 are inactive for side dumping. If the car end 20 at either end of the car is opened (moved to lowered position), cam 66 engages the follower 68 and rotates rocker arm clockwise. And, in turn, crank 71 rotates shaft 55 counter clockwise setting the left side air valve to exhaust the cylinders. At the same time cam 67 also engages its follower 72 and rotates its pivoted crank arm 73 clockwise. The arm 73 is connected to crank 74 by vertical link 75. It should be noted crank 74 is positioned opposite crank 71 on shaft 55 such that each have its free end inwardly of its corresponding rock shaft. This arrangement causes shaft 54 to be rotated clockwise to set the right side air valves for its set of air cylinders to exhaust position; and, simultaneously causes shaft 55 to be rotated counter-clockwise to set the left side air valves for its set of air cylinders to exhaust position. Accordingly, when car end 20 is lowered (opened) neither set of air cylinders can be accidentally activated to dump the car to either side of the track.

Of course, the car end mechanism herein described may be employed on other railway cars than side dumping cars of the illustrated embodiment.

Although the best mode contemplated by the inventor for carrying out the present invention as of the filing date hereof has been shown and described herein, it will be apparent to those skilled in the art that several suitable modifications, variations, and equivalents may be made without departing form the scope of the invention, such scope being limited solely by the terms of the following claims.

What is claimed is:

1. A railway car having a frame and a body supported thereon, said body having a floor, spaced apart longitudinal sides and opposite ends extending above said floor which define a cargo compartment for said car, said car ends being pivotally supported for movement between an upright closed position and a horizontal open position extending outwardly beyond said floor, a lower depending portion on each car end extending below said floor, a cam fixed on said frame adjacent the car end and defining a closed path, said cam having interconnected portions comprising a first vertically extending portion and a second arcuate portion, a follower connected on said lower depending portion of the car end and in running engagement with said cam, a pivot on said lower portion of the car end and disposed above said follower, and a vertical guide for said pivot, said vertical guide attached on the car frame, the closed path of said cam causing the car end to swing above said pivot.

2. The railway car of claim 1 having a fluid-operated dash-pot device connected to the car end and the car frame, said dash pot dampening the swinging movement of the car end between closed and open position.

3. The railway car of claim 2 having a pedestal support fixed on the car frame for engaging the car end when lowered, and defining the open position of said car end.

4. The railway car of claim 1 which includes lower depending portion comprised of posts depending from opposite sides of said car end.

5. The railway car of claim 4 which includes a cam follower on each said post and a separate cam fixed on the frame for engaging each cam follower.

6. The railway car of claim 5 which includes a pair of pivots on said car end disposed at the sides thereof, and corresponding vertical guides on the car frame for the pivots permitting said pivots vertical movement.

7. The railway car of claim 6 wherein said guides comprise a vertical slotted plate receiving the pivot.

8. The railway car of claim 7 in which the pivot includes a retaining plate on the outer end of the pivot, said plate retaining the pivot in its vertical guide.

9. The railway car of claim 1 which includes a pedestal fixed on the frame for supporting and defining the lowered, open position of the car end.

10. The railway car of claim 1 including means on said car end for lifting the car end, thereby moving the follower over the path of said cam.

11. The railway car of claim 2 in which said dash-pot device comprises a cylinder connected to the car frame, a piston and piston rod in said cylinder, said cylinder containing fluid, the piston rod being connected to the car end.

12. A railway car having an underframe and a side dump body supported thereon for tilting sideways by poweroperated hoisting cylinders mounted on either side of the underframe controlled by separate valves, rock shafts supported on the underframe and connected to said valves to activate said cylinders along one of the sides of the underframe for tilting said body and to deactivate the cylinders along the other of the sides of the underframe, said rock shaft rotation in one direction operating the cylinders to tilt said body outwardly for dumping and rotation in the other direction deactivating the cylinders, a drop end on each end of the dump body hingedly connected for swinging movement between vertical closed position and lowered open position, cam means on said drop end, a rocker arm, pivotally supported on the underframe, a cam follower on one end of the rocker arm engageable by said cam upon lowering of said drop end, a crank arm on the rock shaft, a link between the other end of the rocker arm and the crank arm, the cam engaging said follower upon opening said car end to rotate both rock shafts setting all said valves in a nonactive position.

13. A railway car having an underframe and a side dump body supported thereon for tilting sideways by poweroperated hoisting cylinders mounted on either side of the underframe controlled by separate valves, two rock shafts supported on the underframe and connected to said valves to activate said cylinders along one side of the underframe for tilting said body and deactivate cylinders along the other side of the underframe, said rock shaft rotation in one direction operating the cylinders to tilt said body outwardly for dumping and rotation in the other direction deactivating the cylinders, a drop end on each end of the dump body hingedly connected for swinging movement between vertical closed position and lowered open position, cam means on said drop end, a cam follower means supported on the underframe, means connecting the cam follower means to each of the rock shafts for rotating both said rock shafts in said other direction, whereby engaging said follower means by said cam means upon opening said car end causes both said rock shafts to set said valves in a nonactive position.

14. A railway car having a frame and a body supported thereon, said body including a drop end pivotally supported thereon, said car end having a lower depending portion, a cam fixed on said frame defining a closed path, said cam having interconnected portions comprising a first vertically extending portion and a second arcuate portion, a follower connected on said lower depending portion of said car end and in running engagement with said cam, a pivot on said car end disposed above said follower, a vertical guide for said pivot, said vertical guide attached on the car frame, the closed path of said cam causing the car end to swing about said pivot by lifting the car end, whereby the car end is lowered from upright closed position to horizontal open position, a means on the car end for lifting it comprising a bracket projecting interiorly of the car, and a pedestal on the frame for supporting and defining the lowered, open position of the car end.

15. A railway car having a frame and a body supported thereon, said body including a drop end pivotally supported thereon, said car end having a lower depending portion, a cam fixed on said frame and including interconnected surface portions comprising a first vertically extending portion and a second arcuate portion, a follower connected on said lower depending portion of said car end and in running engagement with said cam, a pivot on said car end disposed above said follower, a vertical guide for said pivot, said vertical guide attached on the car frame, the surface portions of said cam causing the car end to swing about said pivot by lifting the car end, a means on the car end for lifting it comprising a laterally extending member on the exterior thereof, and a pedestal on said frame for supporting and defining the lowered, open position of the car end.

16. A railway car having a frame and a body supported thereon, said body including a drop end pivotally supported thereon, said car end having a lower depending portion, a cam fixed on said frame defining a cam surface having interconnected portions comprising a first vertically extending portion and a second arcuate portion, a follower connected on said lower depending portion of the car end and in running engagement with said cam surface, a pivot on said car end disposed above said follower, a vertical guide for said pivot, said vertical guide attached on the car frame, said cam surface causing the car end to swing about said pivot by lifting the car end vertically, and a dash-pot device for dampening the swinging movement of the car end, said dash-pot device comprising a cylinder connected to the car frame, a piston and piston rod in said cylinder, the piston rod being connected to the car end, said cylinder being partially filled with hydraulic fluid, said piston having an axial restriction orifice and an axially disposed ball check valve each connecting the cylinder at one side of the piston with the other side of the piston, said orifice and check valve being disposed in the hydraulic fluid regulating its flow in the cylinder past the piston.

* * * * *